US006470088B2

(12) United States Patent
Schott

(10) Patent No.: US 6,470,088 B2
(45) Date of Patent: Oct. 22, 2002

(54) VENTED LOUDSPEAKER ENCLOSURE WITH LIMITED DRIVER RADIATION

(75) Inventor: Wayne M. Schott, Seymour, TN (US)

(73) Assignee: Koninklijke Philips Electronics, N.V. (NL)

( * ) Notice: Subject to any disclaimer, the term of this patent is extended or adjusted under 35 U.S.C. 154(b) by 0 days.

(21) Appl. No.: 09/749,140

(22) Filed: Dec. 27, 2000

(65) Prior Publication Data

US 2002/0118854 A1 Aug. 29, 2002

(51) Int. Cl.[7] ..... H04R 25/00

(52) U.S. Cl. ..... 381/347; 381/345; 381/349; 381/354

(58) Field of Search ..... 381/345, 346, 381/347, 349, 353, 354, 350, 306, 333, 388; 181/146, 151, 198, 155, 156

(56) References Cited

U.S. PATENT DOCUMENTS 3,037,081 A 5/1962 Carlsson ..... 179/1
3,586,794 A * 6/1971 Michaelis ..... 381/354
3,798,393 A * 3/1974 Gorike ..... 381/347

FOREIGN PATENT DOCUMENTS

| | | | |
|---|---|---|---|
| DE | 2708872 | 3/1978 | ..... H04R/1/28 |
| JP | 09093686 | 4/1997 | ..... H04R/1/28 |

* cited by examiner

*Primary Examiner*—Huyen Le
(74) *Attorney, Agent, or Firm*—Edward W. Goodman

(57) ABSTRACT

A loudspeaker enclosure includes a rectangular cabinet having an acoustical port mounted in one of the vertical walls. A loudspeaker is installed in a bottom wall of the cabinet facing away from an interior volume of the cabinet. A highly resistive acoustic foam is positioned in front of the loudspeaker to restrict the direct radiation of the loudspeaker, so that the usable acoustic radiation emanates from the acoustical port.

4 Claims, 3 Drawing Sheets

VENTED LOUDSPEAKER ENCLOSURE WITH LIMITED DRIVER RADIATION

BACKGROUND OF THE INVENTION

1. Field of the Invention

The subject invention relates to loudspeaker enclosures, and more particularly, to vented loudspeaker enclosures.

2. Description of the Related Art

It is difficult to provide a high quality loudspeaker reproduction of the lowest audio frequencies without resorting to large bulky enclosures.

One solution to this problem is the vented enclosure. U.S. Pat. No. 3,037,081 to Carlsson discloses such an enclosure in the form of an acoustic resonator in which the diaphragm of the loudspeaker forms a part of the wall of the resonator. The enclosure includes at least one port.

While such an enclosure has, at low frequencies, a smooth frequency response curve, good transient response and low non-linear distortion, the low frequency performance still tends to be lacking.

SUMMARY OF THE INVENTION

An object of the invention is to provide a loudspeaker enclosure which has small size and exhibits good low frequency performance.

A further object of the invention is to extend the low frequency response of a vented enclosure by at least one octave.

The above objects are achieved in a loudspeaker enclosure comprising a cabinet for containing a loudspeaker mounted in a wall of said cabinet, said loudspeaker facing away from an internal volume of said cabinet; a port mounted in a further wall of said cabinet; and acoustic resistive foam material positioned in front of said loudspeaker for limiting the amount of direct radiation from the loudspeaker thereby causing most of the usable acoustic radiation to emanate from said port.

Applicant has found that below the tuned frequency of a reflex enclosure, the driver and port radiation are in phase opposition which tends to cancel the usable acoustic output. By limiting the direct speaker radiation, the port radiation can extend the low frequency response by at least one octave.

BRIEF DESCRIPTION OF THE DRAWINGS

With the above and additional objects and advantages in mind as will hereinafter occur, the invention will be described with reference to the accompanying drawings, in which.

DESCRIPTION OF THE PREFERRED EMBODIMENTS

Figure 1:
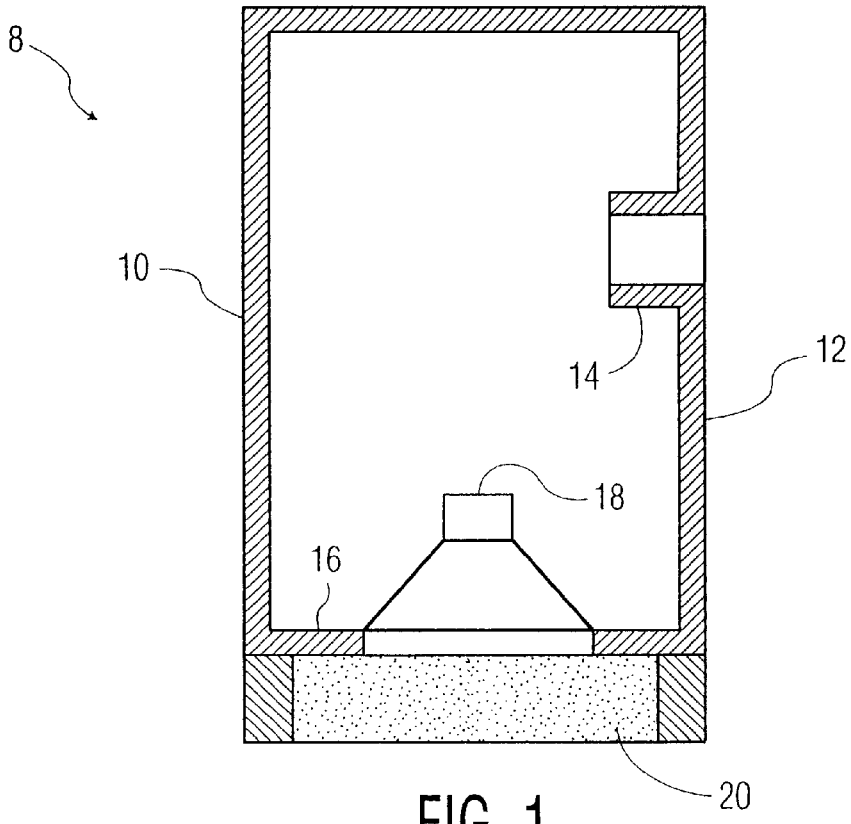
FIG. 1 is an elevational view, partly in section, of a loudspeaker enclosure incorporating the subject invention.

FIG. 1 shows an elevational view, partly in section, of a loudspeaker enclosure. The loudspeaker enclosure 8 includes a rectangular cabinet 10 having at least one vertical side wall 12. An acoustic port 14 is mounted in this side wall 12. A bottom wall 16 of the cabinet 10 has a loudspeaker 18 mounted therein, where the loudspeaker 18 is facing away from the interior volume of the cabinet 10. The area directly in front of the loudspeaker 18 is filled with a highly resistive acoustic foam material 20. Arranged as such, the loudspeaker enclosure 8 of the subject invention exhibits at least an octave extension of the low frequency response, for example, from 60 Hz to 30 Hz.

In a practical embodiment of the loudspeaker enclosure, the cabinet is a cube having 13 inch sides. This yields an internal volume of the cabinet of approximately 1 cu. ft. The port has a length of 2.65 inches and an area of 12.57 sq. in. The loudspeaker has a nominal impedance of 7 ohms and a diameter of 8 in.

Figure 2:
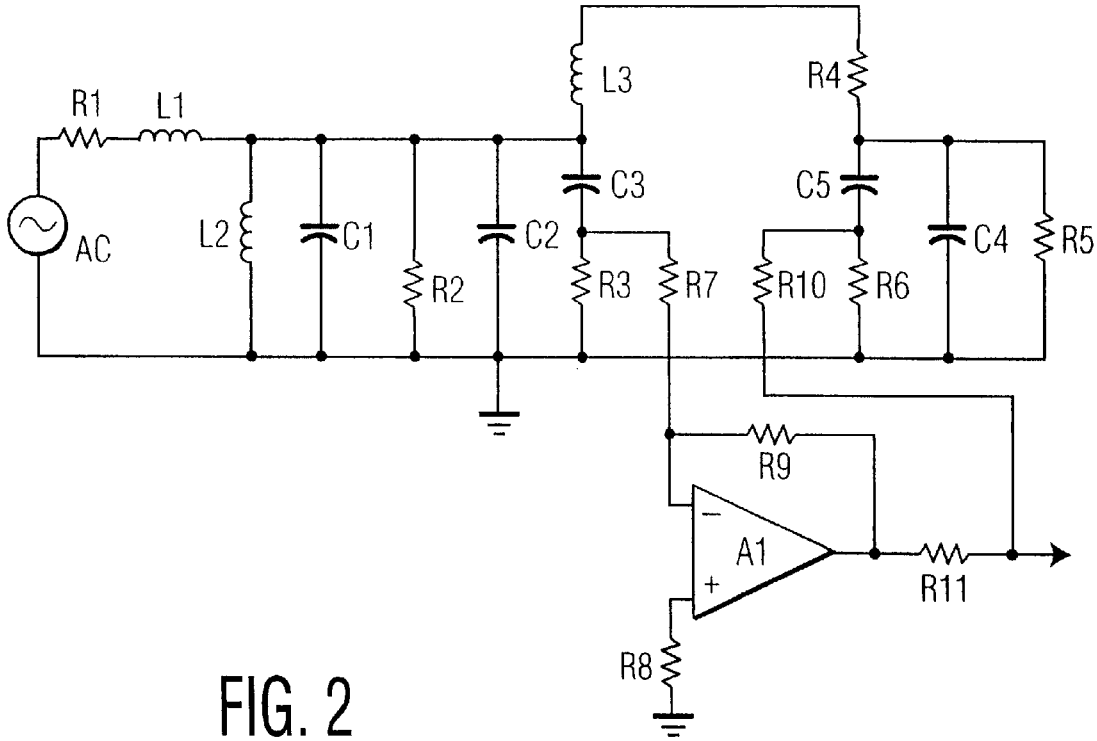
FIG. 2 shows an equivalent circuit diagram of the loudspeaker enclosure of the subject invention.

FIG. 2 shows an equivalent circuit diagram of the loudspeaker enclosure. An AC voltage source, simulating an input to the loudspeaker, is connected to a resistor R1 and an inductor L1. The parallel combination of an inductor L2, a capacitor C1, a resistor R2, a second capacitor C2 and a series combination of a capacitor C3 and a resistor R3 connect the inductor L1 to ground. A series arrangement of an inductor L3 and a resistor R4 are connected to the inductor L1, and the resistor R4 is connected to ground via the parallel combination of a capacitor C4, a resistor R5, and a series combination of a capacitor C5 and a resistor R6. The junction between capacitor C3 and resistor R3 is connected through a resistor R7 to the inverting input of operational amplifier A1, a resistor R8 connecting the non-inverting input to ground, and a resistor R9 connecting the inverting input to the output of operational amplifier A1. A resistor R10 connects the junction between capacitor C5 and resistor R6 to the output of the loudspeaker, while a resistor R11 connects the output of operational amplifier A1 to the loudspeaker output. The operational amplifier A1 serves to create the necessary phase reversal to simulate the difference between the direct radiation of the loudspeaker, applied to the inverting input of operational amplifier A1, and the rear radiation of the loudspeaker, applied to the output through resistor R10.

The value of these components are as follows:

| | VALUE |
|---|---|
| RESISTORS | |
| R1 | 7.5 Ω |
| R2 | 47.43 Ω |
| R3 | 0.1 Ω |
| R4 | 0.51 Ω |
| R5 | 984.6 Ω |
| R6 | 0.67 Ω |
| R7 | 4.732 KΩ |
| R8, R9, R11 | 10 KΩ |
| R10 | 2.041 KΩ |
| CAPACITORS | |
| C1 | 79.82 μF |
| C2, C3 | 77.54 μF |
| C4 | 354.39 μF |
| C5 | 124.67 μF |
| INDUCTORS | |
| L1 | 1 MH |
| L2 | 32.85 MH |
| L3 | 11.63 MH |

Figure 3:
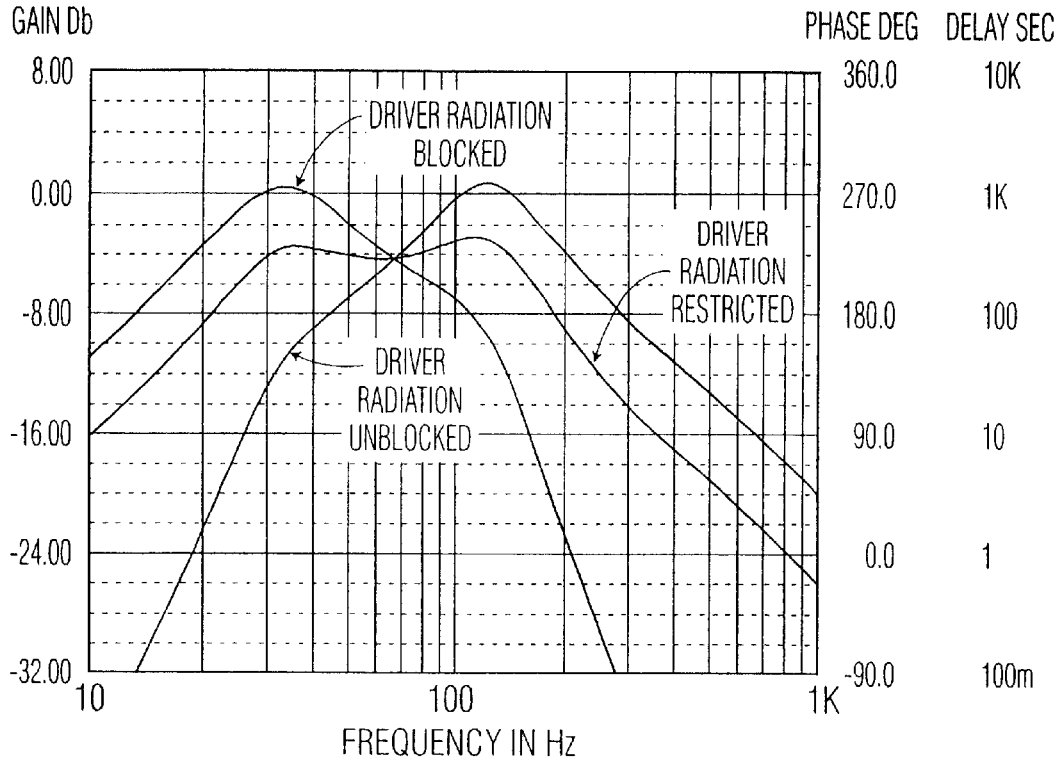
FIG. 3 shows response curves of the loudspeaker enclosure of the subject invention in which the amount of direct radiation is varied.

FIG. 3 shows response curves of the loudspeaker enclosure of the subject invention, in which the amount of direct driver radiation is varied. It should be noted that when the driver is allowed to freely radiate, while the high frequency response (over 100 Hz) is satisfactory, the low frequency response (under approx. 70 Hz) drops off rapidly. When the driver radiation is limited, while the high frequency response is somewhat restricted, the low frequency response is significantly enhanced. While one may suspect that by completely blocking the driver's direct radiation should even more enhance the performance, the response curves show that while the low frequency response may by somewhat enhanced, the high frequency response suffers significantly.

The loudspeaker enclosure of the subject invention may be used within a larger cabinet, as would be the case when the loudspeaker enclosure is used in, for example, a projection television receiver. In that case, the port should vent to the outside of the cabinet of the television receiver.

Figure 4:
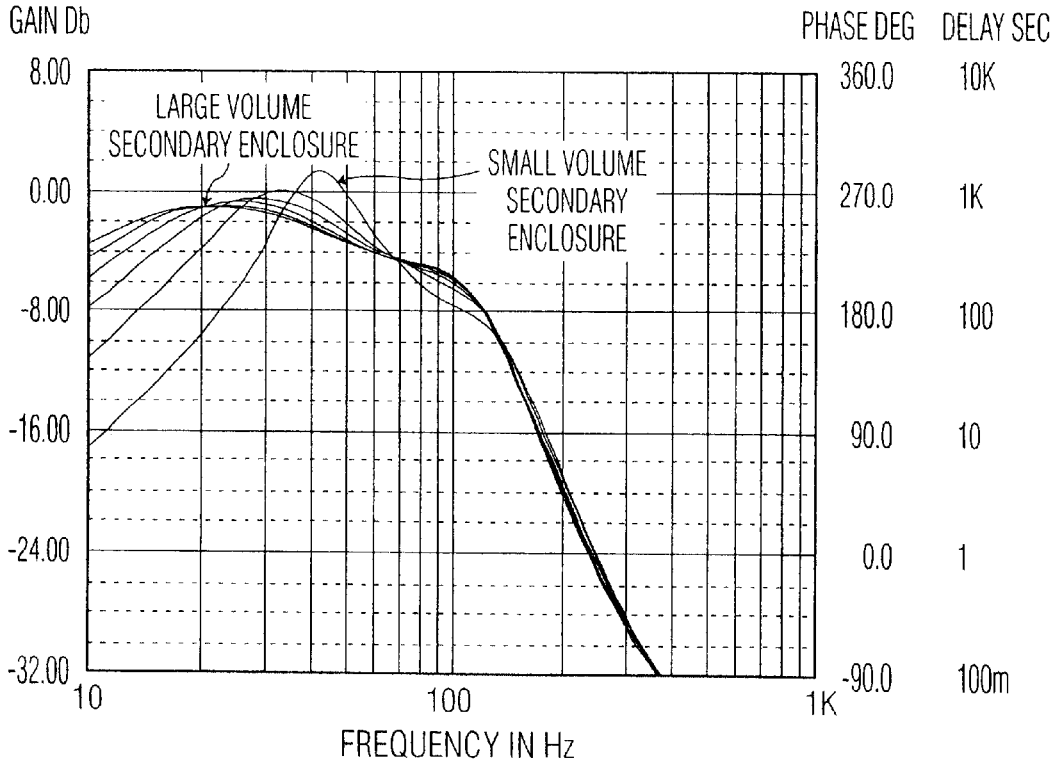
FIG. 4 shows response curves of the loudspeaker enclosure of the subject invention in which the loudspeaker enclosure is installed in a secondary enclosure.

FIG. 4 shows response curves when the loudspeaker enclosure of the subject invention is placed within a secondary cabinet of varying sizes.

Figure 5:
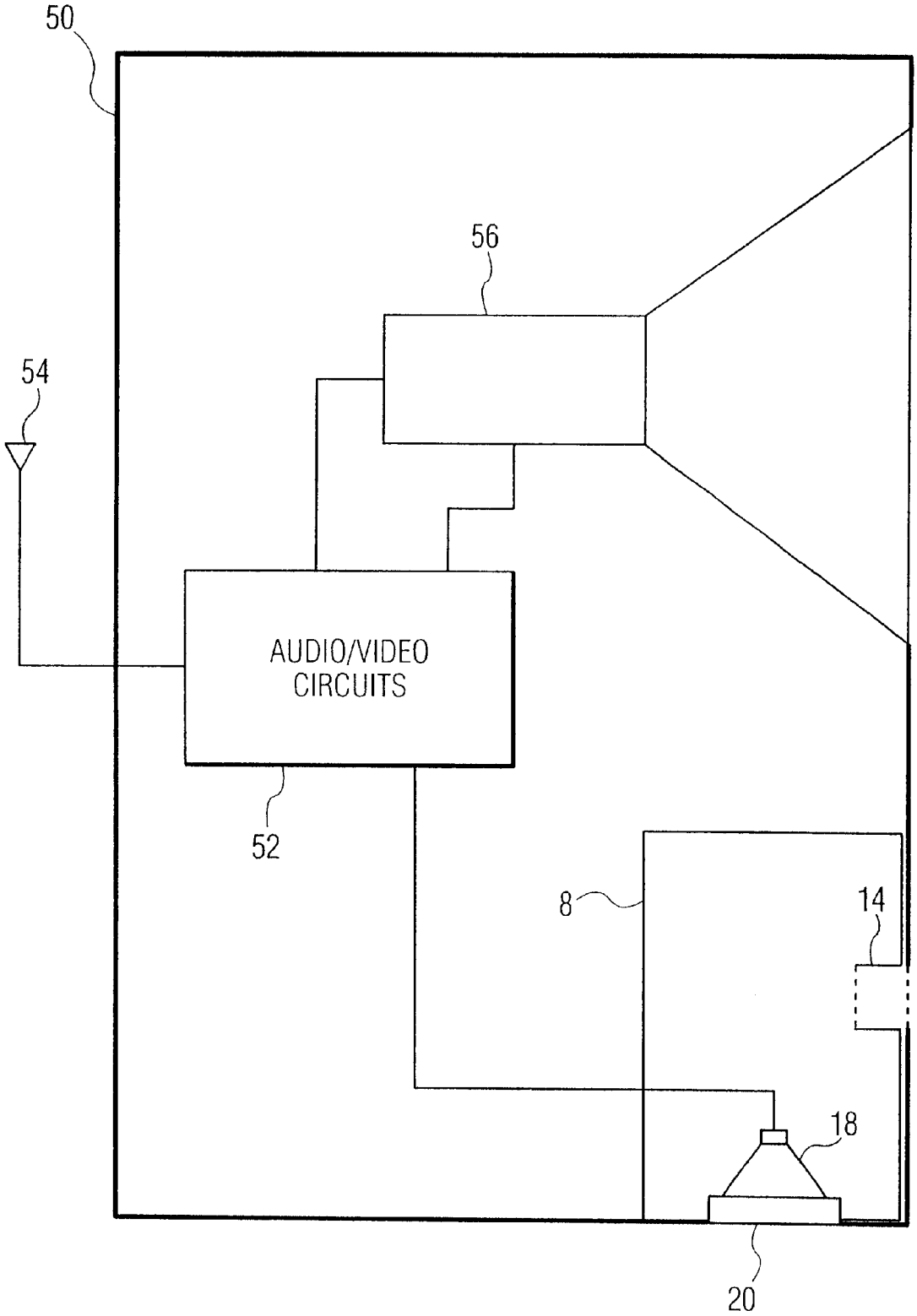
FIG. 5 shows a television receiver incorporating the loudspeaker enclosure of FIG. 1.

FIG. 5 shows the incorporation of the loudspeaker enclosure of the subject invention in a television receiver. The television receiver includes a cabinet 50 and audio/video circuits 52 for receiving television signals from, for example, an antenna 54. The audio/video circuits 52 generate video signals for application to a display device 56 which may be a cathode ray tube. In addition, audio signals from the audio/video circuits 52 are applied to the loudspeaker enclosure 8.

Numerous alterations and modifications of the structure herein disclosed will present themselves to those skilled in the art. However, it is to be understood that the above described embodiment is for purposes of illustration only and not to be construed as a limitation of the invention. All such modifications which do not depart from the spirit of the invention are intended to be included within the scope of the appended claims.

What is claimed is:

1. A loudspeaker enclosure comprising:

a chamber for containing a loudspeaker mounted in a wall of said chamber, said loudspeaker facing away from an internal volume of said chamber;

a port mounted in a further wall of said chamber; and highly resistive acoustic foam material positioned in front of said loudspeaker for limiting the amount of direct radiation from the loudspeaker, thereby causing most of the usable acoustic radiation to emanate from said port.

2. The loudspeaker enclosure as claimed in claim 1, wherein said chamber is rectangular.

3. The loudspeaker enclosure as claimed in claim 2, wherein said port is mounted in a wall adjacent to the wall in which said loudspeaker is mounted.

4. A television receiver comprising:

a cabinet;

circuits mounted within said cabinet for processing television signals to form video and audio signals;

a display mounted in said cabinet and connected to said circuits for displaying said video signals; and sound reproduction means mounted in said cabinet and connected to said circuits for reproducing said audio signals, wherein said sound reproduction means comprises at least one loudspeaker enclosure as claimed in claim 1, in which said port radiates outside of said cabinet.

* * * * *